US010443325B2

(12) United States Patent
Zheng et al.

(10) Patent No.: US 10,443,325 B2
(45) Date of Patent: Oct. 15, 2019

(54) METHOD AND SYSTEM FOR PIPE CONVEYED LOGGING

(71) Applicant: Schlumberger Technology Corporation, Sugar Land, TX (US)

(72) Inventors: Shunfeng Zheng, Katy, TX (US); Vishwanathan Parmeshwar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 99 days.

(21) Appl. No.: 15/694,460

(22) Filed: Sep. 1, 2017

(65) Prior Publication Data

US 2019/0071939 A1 Mar. 7, 2019

(51) Int. Cl.

| | |
|---|---|
| ***E21B 17/02*** | (2006.01) |
| ***E21B 19/08*** | (2006.01) |
| ***E21B 19/00*** | (2006.01) |
| ***E21B 23/14*** | (2006.01) |
| ***E21B 47/12*** | (2012.01) |
| ***E21B 17/20*** | (2006.01) |
| ***E21B 19/22*** | (2006.01) |

(52) U.S. Cl.

CPC ..... *E21B 19/008* (2013.01); *E21B 17/025* (2013.01); *E21B 17/206* (2013.01); *E21B 19/22* (2013.01); *E21B 23/14* (2013.01); *E21B 47/12* (2013.01)

(58) Field of Classification Search

CPC ..... E21B 17/025; E21B 19/008; E21B 19/08; E21B 19/22; E21B 23/14

See application file for complete search history.

(56) References Cited

U.S. PATENT DOCUMENTS

| | | | | |
|---|---|---|---|---|
| 4,282,523 | A | 8/1981 | Youmans | |
| 4,506,729 | A * | 3/1985 | Davis, Jr. | E21B 17/025 166/242.5 |
| 4,603,578 | A * | 8/1986 | Stoltz | F16G 11/048 166/242.5 |
| 5,318,125 | A * | 6/1994 | Wittrisch | E21B 17/025 166/250.01 |
| 5,778,978 | A * | 7/1998 | Crow | E21B 17/025 166/254.2 |
| 5,967,816 | A * | 10/1999 | Sampa | E21B 17/028 439/190 |
| 6,216,789 | B1 | 4/2001 | Lorsignol et al. | |
| 2002/0174388 | A1 * | 11/2002 | Hommel | H04L 41/0677 714/47.1 |
| 2002/0194547 | A1 * | 12/2002 | Christensen | G06F 11/0736 714/43 |
| 2005/0230115 | A1 | 10/2005 | Rose | |
| 2010/0328096 | A1 | 12/2010 | Hache et al. | |
| 2017/0096864 | A1 * | 4/2017 | Blair | B65H 75/425 |

FOREIGN PATENT DOCUMENTS

| | | | |
|---|---|---|---|
| WO | 2017074884 | A1 | 5/2017 |

* cited by examiner

*Primary Examiner* — Giovanna C Wright

(74) *Attorney, Agent, or Firm* — Rachel E. Greene

(57) ABSTRACT

Method and system for pipe conveyed logging (PCL) operations in which the drillpipe conveys a logging tool. The method and system coordinate operation of a wireline winch and drilling rig control systems to synchronize their operation, and/or the method and system attenuate the pull force applied to an upper end of the cable and transmit the attenuated force toward a lower end of the cable to reduce the risks of premature cable release and cable damage.

8 Claims, 4 Drawing Sheets

METHOD AND SYSTEM FOR PIPE CONVEYED LOGGING

CROSS REFERENCE TO RELATED APPLICATION(S)

None.

BACKGROUND

In the oilfield operation, pipe-conveyed logging (PCL) may be used when the well deviates from vertical or is horizontal or otherwise prevents or makes risky wireline or slickline well logging, which depend on gravity to run the logging tool into the well. In this situation, the logging tool is conveyed by the drillpipe, and thus requires the operation of both the wireline winch control system and the drilling rig control system. As a result, PCL is considerably more complicated and much slower than wireline or slickline logging in non-deviated wells.

As shown in FIG. 1, a PCL operation in a borehole H includes the operation of rig equipment, e.g., top drive TD, drawworks DW, drillpipe DP, and so on, and the wireline equipment, e.g., winch W, cable WL, logging tool LT, and so on. The cable WL is secured outside the drillpipe DP with a cable clamp assembly CCA and enters the drillpipe DP through a cable side entry sub (CSES) and is connected to the connector head of the tool LT with a weak point connector WP above the logging tool LT. In the event of a stuck logging tool LT or drillpipe DP, the cable WL may be disconnected at the weakpoint WP by increasing tension on the cable WL at the winch W, allowing the cable WL to be retrieved to the surface S separately from the drillpipe DP.

The operation of the cable WL is controlled through a winch control system WCS operated by a wireline operator via a first human-machine interface (HMI) HMI-1, typically located in a wireline truck WT, which is independent from a rig control system RCS operated by the driller via a second operator via HMI-2. Thus, a successful PCL operation requires close collaboration between the wireline operator and the rig operator that makes the logging complicated, slow, and thus expensive. For example, the winch W must be stopped when the drillpipe DP translation is stopped and the drillpipe DP is held in the rotary table to connect or disconnect stands of pipe into the drillstring Then the winch W must be started as the drillpipe DP translation is started, and then let out or take up the cable WL at the same rate as the rig control system RCS translates the drillpipe DP. During the running-in-hole operation, if the drill pipe DP is run faster than the cable WL, there is a risk of over-tensioning the cable WL and prematurely disconnecting at the weak point WP, or breaking the cable WL. Conversely, if the drill pipe DP runs slower than the cable WL, there is a risk of birdnesting the cable WL in the hole H, causing equipment damage such as kinking the cable WL, jamming the winch W, stuck DP, etc.

The industry has an ongoing need for the development or improvement of PCL operating methods and systems to address one or more of the problems noted above or otherwise.

SUMMARY OF DISCLOSURE

In some embodiments according to the present disclosure, a system to facilitate control of a pipe conveyed logging (PCL) operation may reduce the risks of premature weakpoint release and cable damage, and/or improve efficiency of the PCL operation.

In some embodiments according to the disclosure, a PCL method may comprise adjusting a wireline weakpoint release force by selectively winding the cable at the outside diameter (OD) of the drillstring above the side entry sub, and/or coordinating operation of the wireline winch and drilling rig control systems to automatically synchronize the operation of the systems.

Other aspects and advantages of the disclosure will be apparent from the following description and the appended claims.

GLOSSARY

Figure 1:
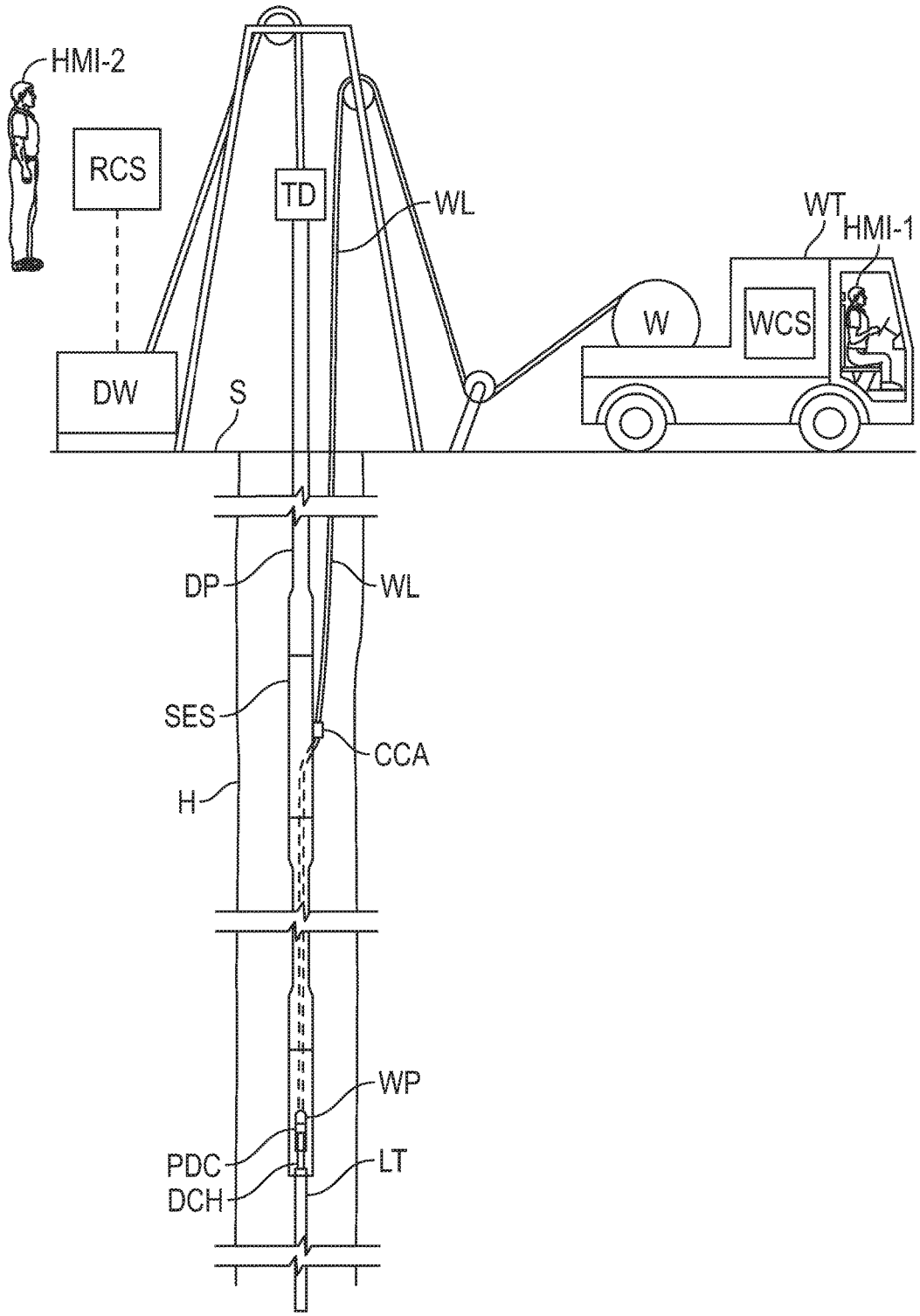
FIG. 1 (Prior Art)
FIG. 1 is a schematic of a conventional pipe conveyed logging (PCL) operation.

"Above", "upper", "heel" and like terms in reference to a well, wellbore, tool, formation, refer to the relative direction or location near or going toward or on the surface side of the device, item, flow or other reference point, whereas "below", "lower", "toe" and like terms, refer to the relative direction or location near or going toward or on the bottom hole side of the device, item, flow or other reference point, regardless of the actual physical orientation of the well or wellbore, e.g., in vertical, horizontal, downwardly and/or upwardly sloped sections thereof.

As used herein, the words "about" or "approximately" are used to refer to numbers or values that may vary by up to 1%, 2%, or 5%.

The term "and/or" refers to both the inclusive "and" case and the exclusive "or" case, whereas the term "and or" refers to the inclusive "and" case only and such terms are used herein for brevity. For example, a component comprising "A and/or B" may comprise A alone, B alone, or both A and B; and a component comprising "A and or B" may comprise A alone, or both A and B.

Attenuate—to lessen or reduce the force, effect, or value of.

Automatic—working by itself with little or no direct human control.

Birdnest—to tangle a line; the resulting tangle.

Borehole or wellbore—the portion of the well extending from the Earth's surface formed by or as if by drilling, i.e., the wellbore itself, including the cased and open hole or uncased portions of the well.

Cable—single-strand or multi-strand the wire or cable used in a well operation or system and connected to downhole tools as they are lowered and raised in a well; also called a wireline.

Cable side entry sub (CSES)—a sub that allows cable to cross over from inside the drillpipe to outside the drillpipe.

Communicating—sharing or exchanging information, data, or signals.

Conjugating—combining, linking, or joining two things together.

Controller—a thing that directs or regulates something.

Control system—a system that manages, commands, directs, or regulates the behavior of other devices or systems.

Coordinate—bring the different elements of a complex system or activity into a harmonious or efficient relationship.

Databus—a communication system that transfers data between components in a device or system.

Deviated wellbore—a wellbore that is inclined from a vertical direction.

Drillpipe—pipe connected in a drillstring.

Drillstring—an assembly of connected pipe, drill collars, and or tools lowered from the surface and extending into a wellbore.

Drive—the transmission of power to machinery.

Top drive—a unit that connects and transmits rotary power to the top of a drillstring.

Each—used to refer to every one of two or more things, regarded and identified separately.

Embodiments—non-limiting tangible or visible forms of an idea or quality according to the present disclosure.

End—the furthest or most extreme part of something.

Force—strength or energy as an attribute of physical action or movement; a push or pull on an object Framework—a basic structure underlying a system or concept.

Human-machine interface—an application or device that interacts with a human operator to present information about the state of a process or system, and to receive control instructions.

Integrated—having various parts or aspects linked or coordinated.

Line—a length of cord, rope, wire, or other material serving a particular purpose, such as pipe or tubing used to transmit flow, sound, light, etc. or cables or wires used to transmit electrical current.

Pipe—a tube of metal, plastic, or other material used to convey or contain water, gas, oil, or other fluid substances.

Release—to set free.

Remote—distant or far away.

Rotary table—a revolving or spinning section of the drillfloor that provides power to turn the drillstring.

Signal—an acoustic, physical, chemical, electrical, electromagnetic, or other impulse transmitted or received.

Slickline—a well operation or system employing single-strand cable connected to downhole tools as they are lowered and raised in a well; the wire or cable used in such operations.

Sub—any small component of a drillstring.

Sub, side entry—a drillstring component that allows passage of a line, component, or material between the inside and outside of the drillstring.

Surface—the surface of the Earth.

Synchronize—cause to occur or operate at the same time or rate.

Tension—apply a force to something that tends to stretch it.

Tool—a device or implement used to carry out a particular function.

Tool, downhole—a device or implement used in a wellbore.

Tool, logging—a device or implement used in a wellbore to collect wellbore or formation data for creation of a record or log, e.g., a sonde.

Pipe conveyed logging (PCL)—logging with a tool carried on drillpipe.

Translate—move from one place to another.

Weakpoint—the location of lowest strength.

Well—a deep hole or shaft sunk into the earth, e.g., to obtain water, oil, gas, or brine.

Winding—wrapping or twisting something around itself or another object; the resulting arrangement.

Wireline—a well operation or system employing single-strand or multi-strand wire or cable connected to downhole tools as they are lowered and raised in a well; the wire or cable used in such or similar operations.

DETAILED DESCRIPTION

In the following description, numerous details are set forth to provide an understanding of the present disclosure. However, it may be understood by those skilled in the art that the methods of the present disclosure may be practiced without these details and that numerous variations or modifications from the described embodiments may be possible. At the outset, it should be noted that in the development of any such actual embodiment, numerous implementation-specific decisions may be made to achieve the developer's specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of this disclosure. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, (1) even if numerous specific data points within the range are explicitly identified, (2) even if reference is made to a few specific data points within the range, or (3) even when no data points within the range are explicitly identified, it is to be understood (i) that the inventors appreciate and understand that any conceivable data point within the range is to be considered to have been specified, and (ii) that the inventors possessed knowledge of the entire range, each conceivable sub-range within the range, and each conceivable point within the range. Furthermore, the subject matter of this application illustratively disclosed herein suitably may be practiced in the absence of any element(s) that are not specifically disclosed herein.

In any embodiment of the disclosure, a pipe conveyed logging (PCL) system may comprise a logging tool conjugated with a lower end of a drillstring, a side entry sub located in the drill string at a distance above the logging tool, and a cable connected to the logging tool and passing inside the drillstring from the logging tool, through the side entry sub, and outside the drillstring above the side entry sub to a winch.

In some embodiments of the present disclosure, the PCL system may comprise an integrated control framework comprising a rig control system to translate the drillstring in a wellbore, a wireline winch control system to translate the cable in the wellbore, and a controller to automatically synchronize the translation of the drillstring and the cable in the wellbore.

The integrated control system may further comprise a databus in communication between the rig control system, the wireline winch control system, and the controller, and or may further comprise a gateway between the rig control system and the databus, a gateway between the wireline winch control system and the databus, or a combination thereof.

The integrated control system may further comprise a human-machine interface in communication with the controller, e.g., the controller may comprise a human-machine interface. In any embodiment, the integrated control system may comprise the human-machine interface in communication with the databus. In some embodiments, the controller may reside in the rig control system, the wireline control system, or a combination thereof, or outside either control system.

In some embodiments, the PCL system may further comprise a drive to rotate the drillstring in the well to selectively wind and unwind the cable at least partially around the drillstring above the cable clamping assembly, e.g., a top drive and/or rotary table. The winding may attenuate a pull force applied to the cable from above the winding, and transmit the attenuated pull force to the cable below the winding. The rig control system may automatically control rotation of the drillstring according to an angle input parameter for the winding corresponding to a desired degree of the attenuation.

In some embodiments, the PCL system may further comprise a cable clamping assembly securing the cable to the drillstring below the winding adjacent to the side entry sub, and the cable clamping assembly may comprise a release set to activate at a predetermined activation force on the cable. The cable clamping assembly release may comprise, for example, shear bolts set to shear at the predetermined activation force.

In some embodiments, the wireline winch control system may have functionality to limit the pull force applied to the cable so that the attenuated pull force at the cable clamping assembly does not exceed the predetermined activation force to activate the cable clamping assembly release. The integrated control framework may comprise an indicator of an allowable maximum of the pull force that can be applied to the cable without the attenuated pull force at the cable clamping assembly exceeding the predetermined activation force to activate the cable clamping assembly release.

In some embodiments, the PCL system may further comprise a weakpoint release formed in the cable at a point between the logging tool and the side entry sub to release the cable from the logging tool upon application of a predetermined release force to the cable at the weakpoint. The weakpoint release may comprise a rope-and-socket connection, for example. The integrated control framework may comprise an indicator of the pull force needed to be applied to the cable above the winding so that the attenuated pull force at the weakpoint equals the predetermined release force to release the cable from the logging tool.

In any embodiment of the disclosure, a PCL method of, for example, making or using any embodiments of the PCL system described herein, may comprise conjugating a logging tool to a lower end of a drillstring, passing a cable from a wireline winch through a side entry sub spaced above the logging tool, passing the cable inside the drillstring below the side entry sub, connecting the cable to the logging tool, and passing the cable into the wellbore outside the drillstring above the side entry sub.

In some embodiments, the PCL method may further comprise translating the drillstring in a wellbore with a rig control system in an integrated control framework, translating the cable in the wellbore with a wireline winch control system in the integrated control framework, and operating a controller in the integrated control framework to automatically synchronize translation of the drillstring and the cable in the wellbore.

In some embodiments, the PCL method may further comprise winding the cable at least partially around the drillstring above the side entry sub. The method may further comprise applying a pull force to the cable from above the winding, and which is attenuated by the winding before transmission to the cable below the winding. The PCL method may further comprise receiving an angle input parameter for the winding corresponding to a desired degree of the attenuation, and automatically controlling rotation of the drillstring according to the angle input parameter.

In some embodiments, the PCL method may further comprise securing the cable to the drillstring below the winding adjacent to the side entry sub, e.g., with a cable clamping assembly, and setting a release of the cable clamping assembly to activate at a predetermined activation force on the cable. For example, the cable clamping assembly release may comprise shear bolts set to shear at the predetermined pull force. The PCL method may further comprise operating the wireline winch control system to limit the pull force applied to the cable so that the attenuated pull force at the cable clamping assembly does not exceed the predetermined activation force to activate the cable clamping assembly release. The PCL method may further comprise displaying an allowable maximum of the pull force that can be applied to the cable without the attenuated pull force at the cable clamping assembly exceeding the predetermined activation force to activate the cable clamping assembly release. The PCL method may further comprise unwinding the cable from around the drillstring, and applying a pull force to the cable so that the pull force at the cable clamping assembly exceeds the predetermined activation force to activate the cable clamping assembly release.

In some embodiments of the disclosure, the PCL method may further comprise forming a weakpoint release in the cable at a point between the logging tool and the side entry sub to release the cable from the logging tool upon application of a predetermined release force to the cable at the weakpoint. The PCL method may further comprise displaying the pull force needed to be applied to the cable above the winding so that the attenuated pull force at the weakpoint would equal the predetermined release force to release the cable from the logging tool. The PCL method may further comprise limiting the pull force applied to the cable above the winding so that the attenuated pull force at the weakpoint does not exceed the predetermined release force that would release the cable from the logging tool. The PCL method may further comprise unwinding the cable from around the drillstring, and applying a pull force to the cable so that the pull force at the weakpoint exceeds the predetermined release force to activate the weakpoint release.

In some embodiments of the present disclosure, the PCL method may further comprise communicating through a databus between the rig control system, the wireline winch control system, and the controller. The PCL method may further comprise conditioning a signal in a gateway between the rig control system and the databus, in a gateway between the wireline winch control system and the databus, or a combination thereof. The PCL method may further comprise communicating between a human-machine interface and the databus, and/or communicating between a human-machine interface and the controller.

In some embodiments according to the present disclosure, a pipe conveyed logging (PCL) method may comprise conjugating a logging tool to a lower end of a drillstring, passing a cable from a wireline winch through a side entry sub spaced above the logging tool, passing the cable inside the drillstring below the side entry sub, connecting the cable to the logging tool, passing the cable into the wellbore outside the drillstring above the side entry sub, at least partially winding the cable around the drillstring above the side entry sub, translating the drillstring and the cable in the wellbore, applying a pull force to the cable above the winding, which is attenuated due to the winding before being transmitted to the cable blow the winding. The PCL method may further comprise unwinding the cable from around the drillstring to remove the attenuation.

Reference is now made to the drawings in which like letters and numerals designate like parts. In some embodiments of the present disclosure, equipment for pipe conveyed logging (PCL) may include a drillstring 10 which may be rotated by a drive 12, e.g., a top drive or rotary table (not shown), and raised or lowered in wellbore 14 via drawworks 16 connected to the drive 12. A logging tool(s) 18, which may be a string of logging tools, is coupled to a lower end of the drillstring 10 and attached to a cable 20 via connector 22, which may, for example, be a pump-down wet connector that can latch onto docking head 24 at the upper end of the logging tool 18. In some embodiments, the cable 20 runs inside the drillstring 10 from the logging tool 18 up to a side entry sub 26, e.g., a cable side entry sub (CSES), where it passes outside the drillstring 10, e.g., into the annulus 27. In some embodiments, the cable 20 may be anchored to the drillstring 10, e.g., at cable clamp assembly 30 which may be located on the side entry sub 26, and up to the surface S where it is connected to winch 28.

Figure 3A:
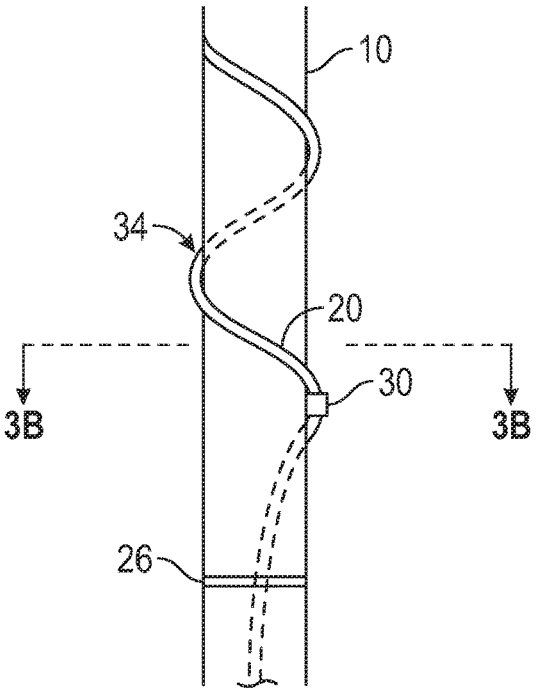
FIG. 3A is a schematic of pull force attenuation in accordance with some embodiments of the present disclosure.

In some embodiments of the disclosure, the cable 20 has a weakpoint 32 disposed between the logging tool 18 and the side entry sub 26, e.g., a rope-and-socket connection between the connector 22 and the cable 20. In some embodiments, the cable 20 is wound at least partially around the outside diameter (OD) of the drillstring 10 at 34 above the side entry sub 26 and the cable clamp assembly 30, if present, as best seen in FIG. 3A. The cable winding 34 adds resistance due to the capstan effect to increase the release force needed at the winch 28 to release the cable 20 from the clamp assembly 30, if present, and the weakpoint 32.

Figure 3B:
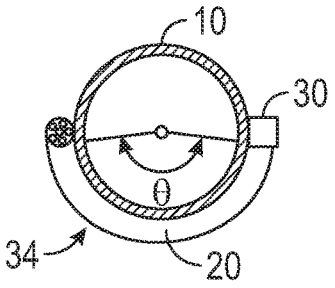
FIG. 3B is a sectional view of the schematic of FIG. 3A as seen along the view lines 3B-3B.

If the release force on the cable 20 at the weakpoint 32 is designed to be $F_0$, in a PCL deployment without any cable winding, the force applied to the wireline at the surface S that is required to break the weakpoint 32 can be estimated as $F_a$ from the following Equation 1:

$$F_a=F_0+F_1+F_2 \tag{1}$$

where $F_0$ is the release force needed at the weakpoint 32, $F_1$ is the weight, or equivalent weight in a deviated well, of the wireline 20 between the weakpoint 32 and the CSES 26, and $F_2$ is the weight, or equivalent weight in a deviated well, of the wireline 20 between the CSES 26 and the surface S. According to embodiments of this disclosure, with the cable winding 34 around the drillstring 10, the applied surface force required to break the weakpoint 32 can be estimated as $F_b$ from the following Equation 2:

$$F_b=F_2+(F_0+F_1)e^{\mu\theta} \tag{2}$$

where μ is the friction coefficient between the cable 20 and the drillstring 10, and as best seen in FIG. 3B, θ is the angle of the cable winding 34 over the drillstring 20, i.e., for each full wind the cable 20 completes around the drillstring 10, the winding angle θ is 2π.

In operation, one can set the release force desired at surface 28 (surface weight) as $F_b$, that is required to break the weakpoint, and determine the corresponding winding angle θ according to Equation 3:

$$\theta=\frac{1}{\mu}\ln\left(\frac{F_b-F_2}{F_0+F_1}\right) \tag{3}$$

where $F_b$, $F_0$, $F_1$, $F_2$, μ, and θ are as defined for Equations 1 and 2. Once the desired angle of winding 34 is determined, during the operation, after the side entry sub 26 is installed, the drillstring 10 may be rotated around the cable 20 to the desired winding angle θ (and/or the cable 20 can be wound around the drillstring 10), then both the drillstring 10 and the cable 20 can resume running in the wellbore 14, while maintaining the rotational orientation of the drillstring 10. As one example, the winch force at surface (surface weight) required to release the cable clamp 30 at the CSES may be 5000 lbs (22.2 kN), and the surface weight required to release the weakpoint may be 8000 lbs (35.6 kN). The angle θ of winding 34 can then be used to add a margin to avoid winch operation prematurely releasing the cable from the clamp assembly 30 and/or weakpoint 32, e.g., an additional 1,000 to 8,000 lbs (4.45 to 35.6 kN).

In embodiments, winding the cable 20 around the drillpipe 10 may be used to prevent premature release of the cable clamp 30 and/or weakpoint 32 during tripping in or tripping out of the wellbore 14, and the cable 20 can be unwound when it is desired to release the cable from the cable clamp 30 and/or weakpoint 32. For example, using the top drive 12 to wind the cable 20 around the drillstring 10 in one direction, e.g. clockwise, the force $F_b$ needed at the winch 28 to break the weakpoint 32 is higher than the force $F_a$ that would otherwise be needed if the cable 20 were not wound around the drillstring 20, and thus the weakpoint 32 and/or the cable clamp 30 is less susceptible to premature release due to uncontrolled increase of the wireline tension at the winch 28. When it is desired to disconnect the weakpoint 32 and/or the cable clamp 30, the wireline winding 34 may be unwound by rotating the drillstring 10 with the top drive 12 in the opposite direction, e.g. counter-clockwise. Once the cable 20 is unwound to a winding angle θ of zero, e.g., the force at the winch 28 required to break the weakpoint 32 is reduced to the smaller quantity $F_a$.

In an exemplary operation, the docking head 24 may be used to connect the top of the tool 18 to the lower end of the drillstring 10. Stands of drillpipe are then connected into the drillstring 10 and run into the borehole 14, e.g., to the top of the interval to be logged, which may, for example, be at a casing shoe. The CSES 26 is inserted and the cable 20 is threaded through it. Then, the wet-connect sub 22 is attached to the cable 20 and pumped downhole in the drillstring 10. The wet-connect sub 22 attaches to the docking head 24, and establishes an electrical connection to the tool string 18. Next, if desired, the cable 20 may be anchored to the drillstring 10, e.g., at or near the CSES 26, with the clamp assembly 30 and rotated with the drillstring 10 to the desired winding angle θ. The drillstring 10 may then advance the tool string 18 for logging by adding additional stands above the CSES 26, using the top drive 12 to maintain the desired degree of rotation.

As another example, the PCL method may be employed when a conventional wireline logging operation, without PCL, has resulted in the logging tool 18 becoming stuck in the wellbore 14. In this example, the tool 18 may start out in the wellbore 14 already connected to the cable 20. A cut-and-thread procedure may be used, e.g., cutting the cable 20 above the surface S, connecting a grappler (not shown) on the lower end of a drillstring 10, and threading the lower cut end of the cable 20 in the wellbore 14 through successive stands of the drillstring 10 as they are added. When the tool 18 is reached, the grappler may connect to it. Then a cable-cutting tool (not shown) and the CSES 26 may be installed into the drillstring 10, and the cut end of the cable 20 threaded through the CSES 26 outside the drillstring 10, connected to the other end of the cut cable using, for example, a double-ended torpedo (not shown), optionally anchored with the cable clamp assembly 30, and if desired wound around the drillstring 10 as needed (see FIGS. 3A and 3B). Then logging may proceed by advancing the tool 18 into the wellbore 14, passing the cable 20 into the wellbore 14 outside the drillstring 10 as additional stands are added. If desired, when the logging operation is complete, the cable-cutting tool, if present, may be used to cut the cable 20 below the CSES 26, and the drillstring 10 and cable 20 may be separately removed from the wellbore 14.

Figure 2:
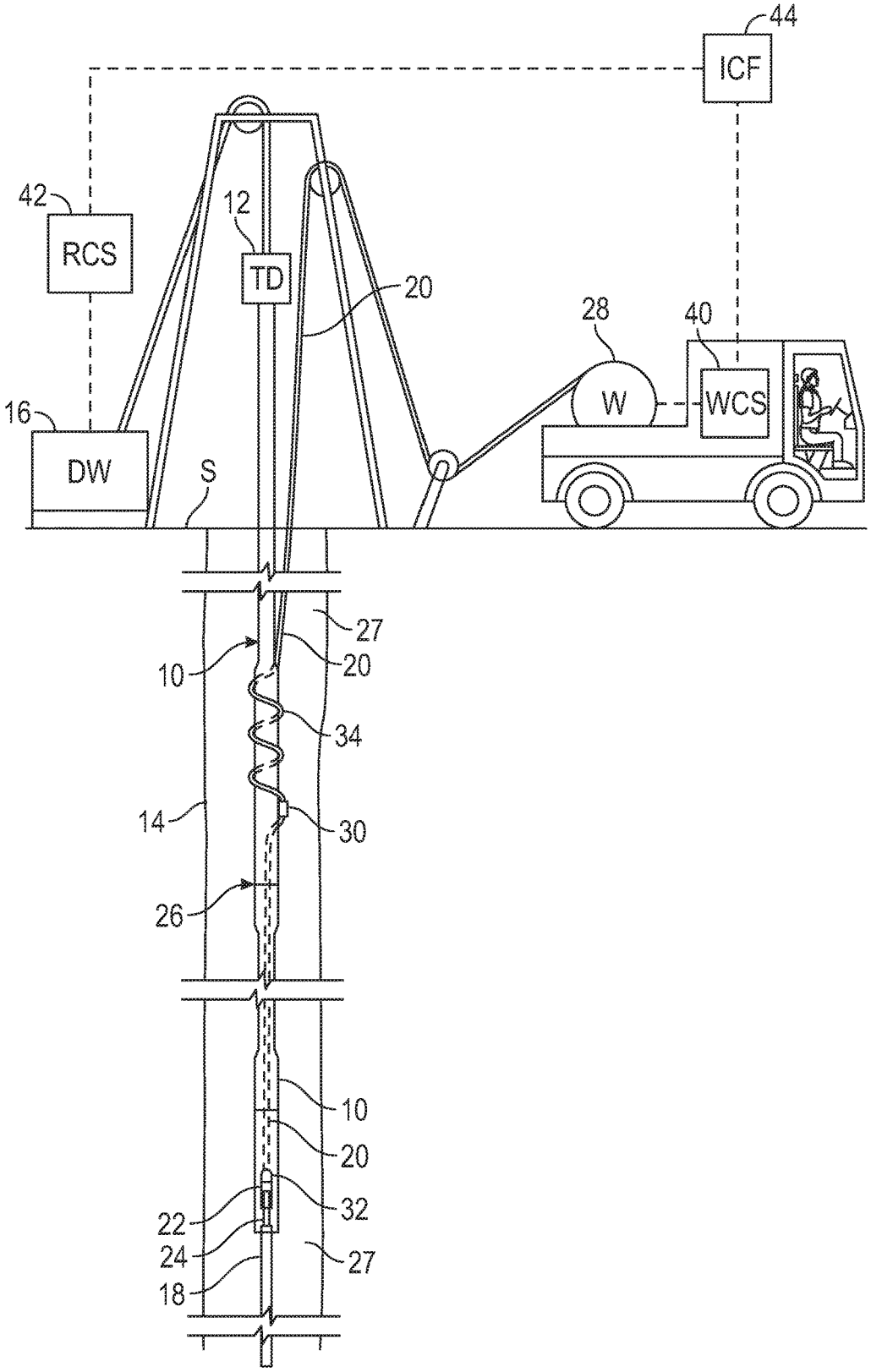
FIG. 2 is a schematic of a PCL operation in accordance with some embodiments of the present disclosure.

With reference to FIG. 2, the cable 20 and winch 28 are controlled through a wireline winch control system (WCS) 40, and rig equipment is controlled by a rig control system (RCS) 42. In some embodiments of the present disclosure, the operation of the WCS 40 and the RCS 42 is coordinated in an integrated control framework (ICF) 44 for a synchronous translation of the drillstring 10 and cable 20 in or out of the wellbore 14. The ICF 44 may be disposed on the drilling rig, e.g., with the RCS 42, or in the wireline truck, e.g., with the WCS 40, or in a separate location(s), or parts of the ICF 44 distributed among these and/or other locations. By integrating both control systems 40, 42 into the same control framework 44, according to some embodiments of the present disclosure, both control systems 40,42 may be automatically synchronized such that the drillstring 10 and the cable 20 are run in sync with a substantially reduced risk of overstretching, prematurely releasing at the weakpoint 30 or cable clamping assembly 32, birdnesting, and/or otherwise damaging the cable 20.

Figure 4:
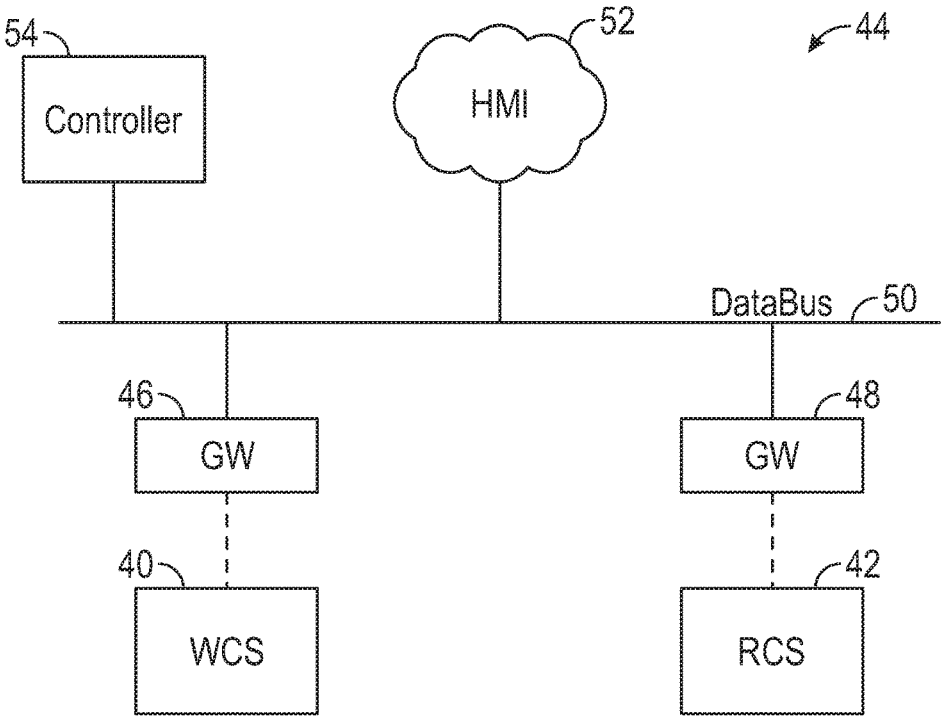
FIG. 4 is a schematic of an integrated control system for a PCL operation in accordance with some embodiments of the present disclosure.

According to some embodiments of the present disclosure, FIG. 4 exemplifies wireline winch control system 40 and rig control system 42 integrated into the control framework 44. An optional first gateway 46 may be provided to convert status and command data from the WCS 40 to an optional common databus 50. An optional second gateway 48 may be provided to convert the status and command data from the RCS 42 to the common databus 50, if present. The common databus 50, if present, is connected to an operation station 52, which may, for example, be a human-machine interface (HMI). If desired, the common databus 50, if present, may also connect to a controller 54, which may be used to coordinate and synchronize the control of the WCS 40 and RCS 42.

The common databus 50, if present, may, for example, use real time field bus communication protocols, such as PROFIBUS, MODBUS, or the like; or other real time, Ethernet-based communication protocols, such as EtherCAT, EtherNet IP, or the like; or real time communication middleware, such as a distributed data service (DDS) to enable high performance control of RCS 40 and RCS 42.

Figure 5:
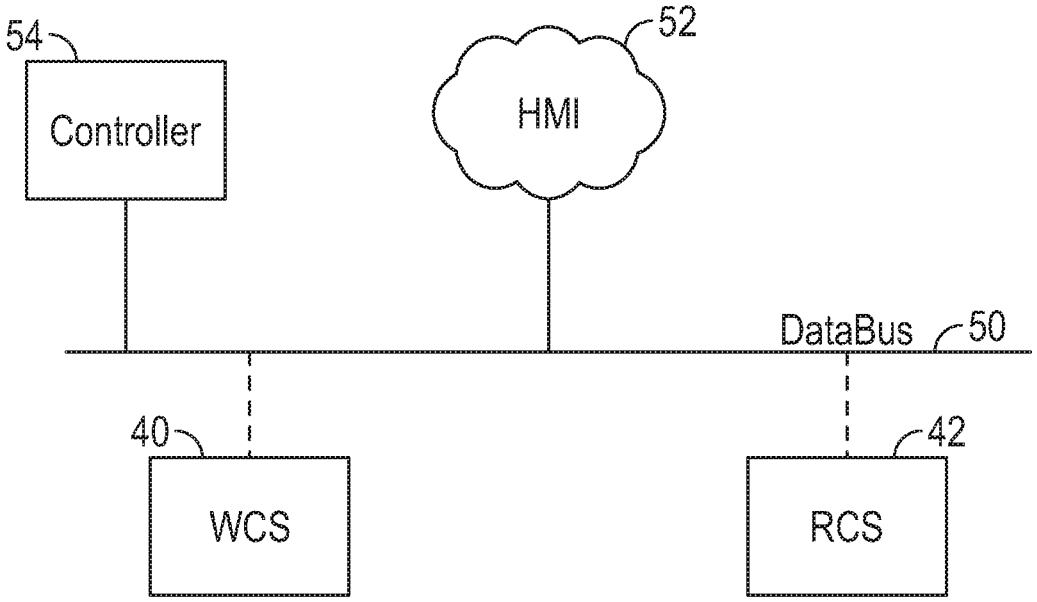
FIG. 5 is a schematic of another integrated control system for a PCL operation in accordance with some embodiments of the present disclosure.

According to some embodiments of the disclosure, as seen in FIG. 5, the WCS 40 and/or RCS 42 may use the same communication protocol as the common databus 50, e.g. ProfiNet, ProfiBus, ModBus, ModBus TCP, Ethernet IP, EtherCAT, or the like, and communicate directly without the use of a gateway(s).

In operation, instead of using a separate operation station HMI-1 for the WCS and separate operation station HMI-2 for the RCS, and two separate operators, as seen in FIG. 1, only a single HMI operation station 52 may be needed for a PCL job, as seen in FIG. 4 and FIG. 5. Control command is issued through the HMI 52, which may directly pass to each individual control system, or may be dispatched and monitored via the controller 54 to each individual control system 40, 42, to control the speed of both the drillstring 10 and the cable 20 such that they are synchronously raised from or lowered into the wellbore 14.

The description herein is with reference to use of the PCL system or method in deviated or horizontal wellbores, as an example, not a limitation, and the PCL system may also be used in non-deviated or other wellbores. The PCL system and method may likewise be used in other applications, such as, for example, logging while fishing, e.g., after a wireline logging operation has resulted in a stuck tool.

EMBODIMENTS LISTING

In some aspects, the disclosure herein relates generally to pipe conveyed logging methods, equipment, and/or systems according to the following Embodiments, among others:

1. A pipe conveyed logging (PCL) system, comprising:
   a logging tool conjugated with a lower end of a drillstring;
   a cable side entry sub located above the logging tool; and
   a cable connected to the logging tool and passing inside the drillstring from the logging tool, through the cable side entry sub, and outside the drillstring above the cable side entry sub to a winch.
2. The pipe conveyed logging (PCL) system of Embodiment 1, further comprising an integrated control framework comprising a rig control system to translate the drillstring in a wellbore, a wireline winch control system to translate the cable in the wellbore, and a controller to automatically synchronize the translation of the drillstring and the cable in the wellbore.
3. The PCL system of Embodiment 1 or Embodiment 2, further comprising a drive to rotate the drillstring in the well to wind the cable at least partially around the drillstring above the cable clamping assembly, e.g., to assist the tripping the drilling string and wireline in or out of the well; and/or to unwind the cable, e.g., when it is desired to assist the release of the cable clamp or weakpoint.
4. The PCL system of Embodiment 3, wherein a pull force applied to the cable from above the winding is attenuated before transmission to the cable below the winding.
5. The PCL system of Embodiment 4, wherein the rig control system automatically controls rotation of the drillstring according to an angle input parameter for the winding corresponding to a desired degree of the attenuation.

6. The PCL system of Embodiment 5, further comprising a cable clamping assembly securing the cable to the drillstring below the winding adjacent to the cable side entry sub and comprising a release set to activate at a predetermined activation force on the cable.
7. The PCL system of Embodiment 6, wherein the cable clamping assembly release comprises shear bolts set to shear at the predetermined activation force.
8. The PCL system of Embodiment 6 or Embodiment 7, wherein the wireline winch control system has functionality to limit the pull force applied to the cable so that the attenuated pull force at the cable clamping assembly does not exceed the predetermined activation force to activate the cable clamping assembly release.
9. The PCL system of any of Embodiments 6 to 8, wherein the integrated control framework comprises an indicator of an allowable maximum of the pull force that can be applied to the cable without the attenuated pull force at the cable clamping assembly exceeding the predetermined activation force to activate the cable clamping assembly release.
10. The PCL system of Embodiment 5, further comprising a weakpoint release formed in the cable at a point between the logging tool and the side entry sub to release the cable from the logging tool upon application of a predetermined release force to the cable at the weakpoint.
11. The PCL system of any of Embodiments 2 to 10, wherein the integrated control framework comprises an indicator of the pull force at surface needed to break the weakpoint to release the cable from the logging tool as a result of any winding.
12. The PCL system of any of Embodiments 2 to 11, wherein the integrated control system further comprises a databus in communication between the rig control system, the wireline winch control system, and the controller.
13. The PCL system of Embodiment 12, further comprising a gateway between the rig control system and the databus, a gateway between the wireline winch control system and the databus, or a combination thereof
14. The PCL system of any of Embodiment 12 and Embodiment 13, wherein the integrated control system comprises a human-machine interface in communication with the databus.
15. The PCL system of any of Embodiments 2 to 14, wherein the integrated control system further comprises a human-machine interface in communication with the controller.
16. The PCL system of any of Embodiments 2 to 15, wherein the controller resides in the rig control system, the wireline control system, or a combination thereof; or wherein the controller resides separately outside the rig control system and the wireline control system.
17. The system of any of Embodiments 1 to 16, wherein the wellbore is deviated or horizontal.
18. A pipe conveyed logging (PCL) system optionally according to any one of Embodiments 1 to 17, comprising:
a logging tool conjugated with a lower end of a drillstring;
a cable side entry sub located above the logging tool;
a cable connected to the logging tool and passing inside the drillstring from the logging tool, through the cable side entry sub, and outside the drillstring above the side entry sub to a winch;
a cable clamping assembly securing the cable to the drillstring adjacent to the cable side entry sub and comprising a release set to activate at a predetermined pull force on the cable;
a weakpoint formed in the cable between the logging tool and the cable side entry sub to release the cable from the logging tool upon application of a predetermined release force to the cable at the weakpoint; and
a drive to selectively wind and unwind the cable at least partially around the drillstring above the cable clamping assembly, e.g. winding for tripping and unwinding before releasing the cable at the weakpoint.
19. A pipe conveyed logging (PCL) method, comprising:
(a) conjugating a logging tool to a lower end of a drillstring;
(b) passing a cable from a wireline winch through a cable side entry sub spaced above the logging tool;
(c) passing the cable inside the drillstring below the cable side entry sub;
(d) connecting the cable to the logging tool;
(e) passing the cable into the wellbore outside the drillstring above the cable side entry sub;
(f) translating the drillstring in a wellbore with a rig control system in an integrated control framework;
(g) translating the cable in the wellbore with a wireline winch control system in the integrated control framework; and
(h) operating a controller in the integrated control framework to automatically synchronize translation of the drillstring and the cable in the wellbore.
20. The PCL method of Embodiment 19, further comprising winding the cable at least partially around the drillstring above the side entry sub.
21. The PCL method of Embodiment 20, further comprising:
attenuating a pull force applied to the cable from above the winding; and
transmitting the attenuated pull force to the cable below the winding.
22. The PCL method of Embodiment 20 or Embodiment 21, further comprising:
receiving an angle input parameter for the winding corresponding to a desired degree of the attenuation; and
automatically controlling rotation of the drillstring according to the angle input parameter.
23. The PCL method of any of Embodiments 20 to 22, further comprising:
securing the cable to the drillstring below the winding adjacent to the side entry sub with a cable clamping assembly; and
setting a release of the cable clamping assembly to activate at a predetermined activation force on the cable.
24. The PCL method of Embodiment 23, wherein the cable clamping assembly release comprises shear bolts set to shear at the predetermined pull force.
25. The PCL method of Embodiment 23 or Embodiment 24, further comprising operating the wireline winch control system to limit the pull force applied to the cable so that the attenuated pull force at the cable clamping assembly does not exceed the predetermined activation force to activate the cable clamping assembly release.
26. The PCL method of any of Embodiments 23 to 25, further comprising displaying an allowable maximum of the pull force that can be applied to the cable without the attenuated pull force at the cable clamping assembly exceeding the predetermined activation force to activate the cable clamping assembly release.

27. The PCL method of any of Embodiments 23 to 26, further comprising:
unwinding the cable from around the drillstring; and
applying a pull force to the cable so that the pull force at the cable clamping assembly exceeds the predetermined activation force to activate the cable clamping assembly release.
28. The PCL method of any of Embodiments 20 to 27, further comprising forming a weakpoint release in the cable at a point between the logging tool and the side entry sub to release the cable from the logging tool upon application of a predetermined release force to the cable at the weakpoint.
29. The PCL method of Embodiment 28, further comprising displaying the pull force needed to be applied to the cable above the winding so that the attenuated pull force at the weakpoint would equal the predetermined release force to release the cable from the logging tool.
30. The PCL method of Embodiment 28 or Embodiment 29, further comprising limiting the pull force applied to the cable above the winding so that the attenuated pull force at the weakpoint does not exceed the predetermined release force that would release the cable from the logging tool.
31. The PCL method of any of Embodiments 28 to 30, further comprising:
unwinding the cable from around the drillstring; and
applying a pull force to the cable so that the pull force at the weakpoint exceeds the predetermined release force to activate the weakpoint release.
32. The PCL method of any of Embodiments 19 to 31, further comprising communicating through a databus between the rig control system, the wireline winch control system, and the controller.
33. The PCL method of Embodiment 32, further comprising conditioning a signal in a gateway between the rig control system and the databus, in a gateway between the wireline winch control system and the databus, or a combination thereof
34. The PCL method of Embodiment 32 or Embodiment 33, further comprising communicating between a human-machine interface and the databus.
35. The PCL method of any of Embodiments 19 to 34, further comprising communicating between a human-machine interface and the controller.
36. A pipe conveyed logging (PCL) method, optionally according to any of Embodiments 19 to 35, comprising:
(a) conjugating a logging tool to a lower end of a drillstring;
(b) passing a cable from a wireline winch through a cable side entry sub spaced above the logging tool;
(c) passing the cable inside the drillstring below the cable side entry sub;
(d) connecting the cable to the logging tool;
(e) placing a weakpoint in the cable between the cable side entry sub and the logging tool;
(f) passing the cable into the wellbore outside the drillstring above the cable side entry sub;
(g) at least partially winding the cable around the drillstring above the cable side entry sub; and
(h) translating the drillstring and the cable in the wellbore.
37. The PCL method of Embodiment 36, further comprising applying a pull force to the cable above the winding.
38. The PCL method of Embodiment 36 or Embodiment 37, further comprising unwinding the cable from around the drillstring to remove the attenuation.

Although only a few exemplary embodiments have been described in detail above, those skilled in the art will readily appreciate that many modifications are possible in the example embodiments without materially departing from this disclosure. For example, any embodiments specifically described may be used in any combination or permutation with any other specific embodiments described herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' or 'step for' together with an associated function without the recitation of structure.

What is claimed is:

1. A pipe conveyed logging (PCL) system, comprising:
a logging tool conjugated with a lower end of a drillstring;
a cable side entry sub located above the logging tool;
a cable connected to the logging tool and passing inside the drillstring from the logging tool, through the cable side entry sub, and outside the drillstring above the cable side entry sub to a winch;
a weakpoint release formed in the cable at a point between the logging tool and the cable side entry sub to release the cable from the logging tool upon application of a predetermined release force to the cable at the weakpoint; and
an integrated control framework comprising a rig control system to translate the drillstring in a wellbore, a wireline winch control system to translate the cable in the wellbore, and a controller to automatically synchronize the translation of the drillstring and the cable in the wellbore,
further comprising a drive to rotate the drillstring in the well to selectively wind and unwind the cable at least partially around the drillstring above a cable clamping assembly.

2. The PCL system of claim 1, wherein the rig control system automatically controls rotation of the drillstring according to an angle input parameter for a winding corresponding to a desired degree of the attenuation.

3. The PCL system of claim 2, further comprising a cable clamping assembly securing the cable to the drillstring below a winding adjacent to the cable side entry sub and comprising a release set to activate at a predetermined activation force on the cable.

4. The PCL system of claim 3, wherein the wireline winch control system has functionality to limit a pull force applied to the cable so that the pull force transmitted the cable clamping assembly does not exceed the predetermined activation force to activate the cable clamping assembly release.

5. The PCL system of claim 4, wherein the integrated control framework comprises an indicator of an allowable maximum of the pull force that can be applied to the cable without an attenuated pull force at the cable clamping assembly exceeding the predetermined activation force to activate the cable clamping assembly release.

6. A pipe conveyed logging (PCL) system, comprising:

a logging tool conjugated with a lower end of a drillstring;

a cable side entry sub located above the logging tool;

a cable connected to the logging tool and passing inside the drillstring from the logging tool, through the cable side entry sub, and outside the drillstring above the cable side entry sub to a winch;

a weakpoint release formed in the cable at a point between the logging tool and the cable side entry sub to release the cable from the logging tool upon application of a predetermined release force to the cable at the weakpoint; and an integrated control framework comprising a rig control system to translate the drillstring in a wellbore, a wireline winch control system to translate the cable in the wellbore, and a controller to automatically synchronize the translation of the drillstring and the cable in the wellbore, wherein the integrated control framework comprises an indicator of a pull force at surface needed to break the weakpoint to release the cable from the logging tool as a result of any winding.

7. A pipe conveyed logging (PCL) method, comprising:

(a) conjugating a logging tool to a lower end of a drillstring;

(b) passing a cable from a wireline winch through a cable side entry sub spaced above the logging tool;

(c) passing the cable inside the drillstring below the cable side entry sub;

(d) connecting the cable to the logging tool;

(e) placing a weakpoint in the cable between the cable side entry sub and the logging tool;

(f) passing the cable into the wellbore outside the drillstring above the cable side entry sub;

(g) at least partially winding the cable around the drillstring above the cable side entry sub;

(h) translating the drillstring and the cable in the wellbore.

8. The PCL method of claim 7, further comprising unwinding the cable from around the drillstring to before activating the process to release break the weakpoint.

* * * * *